US005211341A

United States Patent [19]

Wieczorek

[11] Patent Number: 5,211,341

[45] Date of Patent: May 18, 1993

[54] FUEL INJECTOR VALVE HAVING A COLLARED SPHERE VALVE ELEMENT

[75] Inventor: David P. Wieczorek, Newport News, Va.

[73] Assignee: Siemens Automotive L.P., Auburn Hills, Mich.

[21] Appl. No.: 684,619

[22] Filed: Apr. 12, 1991

[51] Int. Cl.[5] ..... B05B 47/02

[52] U.S. Cl. ..... 239/585.3; 239/900; 251/129.16

[58] Field of Search ..... 251/129.14, 129.17, 251/129.16, 129.19, 129.15; 239/585, 585.1, -585.5, 900

[56] References Cited

U.S. PATENT DOCUMENTS

| | | | |
|---|---|---|---|
| 2,828,936 | 4/1958 | Hales | 251/129.14 X |
| 4,798,329 | 1/1989 | Mesenich | 239/585 X |
| 4,800,912 | 1/1989 | Hafner et al. | 239/585 X |
| 4,852,605 | 8/1989 | Gouhier | 251/129.17 X |
| 5,054,691 | 10/1991 | Huang et al. | 239/585 |
| 5,060,868 | 10/1991 | Knapp et al. | 239/585 |

*Primary Examiner*—Andres Kashnikow
*Assistant Examiner*—Kevin P. Weldon
*Attorney, Agent, or Firm*—George L. Boller; Russel C. Wells

[57] ABSTRACT

The collared sphere is a separate part that is assembled into the valve during the assembly process. A resilient spring disc acts through the collar on the sphere to hold the sphere in abutment with the tip end of the armature as the armature reciprocates to open and close the valve. The disc is also a separate part that is assembled into the valve during the assembly process. The outer margin of the disc is supported on a raised ledge without attachment thereto while the sphere fills slightly less than a central circular void in the disc whose diameter is less than that of the sphere. The valve seat is frustoconical, and the disc acts through the collar to maintain the sphere at least approximately concentric with the seat so that when the valve is operated closed any misalignment of the sphere to the seat is taken out by the camming action of the seat on the sphere as the valve closes. The collar provides the interface between the sphere and the disc and comprises an inside diameter cradling surface for the sphere and a further surface that abuts the disc in bounding relation to the central circular void.

17 Claims, 2 Drawing Sheets

FUEL INJECTOR VALVE HAVING A COLLARED SPHERE VALVE ELEMENT

FIELD OF THE INVENTION

This invention relates to electrically operated valves, such as those commonly used to inject fuel into spark-ignited internal combustion engines.

BACKGROUND AND SUMMARY OF THE INVENTION

In fuel injectors the valving mechanism typically comprises a reciprocal valve element that seats on and unseats from a valve seat. Sealing of the valve element to the valve seat, when the fuel injector is closed, is important in avoiding fuel leakage, or drip. Since the sealing is attained by only metal-to-metal contact, the shapes of the valve element and the seat are especially important. A valve element which has a spherical contoured surface for seating on a frusto-conical valve seat has been found to provide effective sealing. Various designs have been proposed for embodying a spherically contoured surface in a fuel injector valve element.

In one known design, the distal end of a cylindrical needle is shaped to have essentially a semi-spherical surface. In another known design, a truncated sphere (slightly larger than a semi-sphere for example) is the valve element. In still another known design, an entire sphere is joined to one end of a tube. The use of any of these designs affects the fuel injector cost because they require certain metal joining and/or metal removing operations in order to make the valve element.

The use of a simple sphere is advantageous because such spheres can be economically fabricated with precision in large volumes. Because of the cost disadvantages which are inherent in the known designs just described, it would be beneficial if a fuel injector could incorporate a sphere with minimal use of metal joining and/or metalworking operations on the sphere.

Another factor that contributes to the cost of known fuel injector designs, such as those in which the spherical contoured surface is at one end of an elongated member, is the necessity of securing precise alignment of the valve member to the seat. Precision metalworking operations must be conducted on several individual parts, and assembly of the parts must be carefully performed. Even with the use of sophisticated manufacturing techniques, today's mass-production of fuel injectors still results in a significant percentage which are unable to meet engineering performance specifications when tested after assembly. These injectors must be then re-worked, resulting in added cost.

A still further consideration in fuel injector design is the desire to miniaturize fuel injectors for certain uses. Fuel injectors which are presently in commercial production are not large parts, but the market is seeking injectors which are even smaller. Such miniaturized fuel injectors will require smaller individual parts, and because such parts are more difficult to process, manufacturing complexity is likely to be amplified. This is a further reason why a sphere which requires a minimum of processing for turning it into a suitable valve element would be desirable.

Commonly assigned co-pending application Ser. No. 07/604,693, filed Oct. 26, 1990 now U.S. Pat. No. 5,076,499, relates to a new and improved electrically-operated fuel injector which utilizes a simple sphere as the valve element. The process for fabricating the fuel injector does not require the use of joining or metalworking operations on the sphere: the sphere is simply one of the individual parts of the fuel injector. The sphere is disposed to seat in a smaller diameter circular through-hole in the center of a resilient spring disc that acts to keep the sphere against the armature. The outer margin of the spring disc is supported on an internal circular ledge of the injector body in such a way that the disc and sphere can shift radially and thereby make the sphere self-aligning to the seat. The organization and arrangement of the fuel injector provides for the inherent self-alignment of the sphere to the seat while avoiding the precision finishing operations required to secure the accurate alignment of the valve element with the valve seat in known fabrication procedures. The organization and arrangement is also adapted to render the fuel injector well-suited for miniaturization. Thus electrically-operated fuel injectors can be fabricated without incurring prohibitively expensive manufacturing costs.

The present invention relates to an improvement in the fuel injectors of the type disclosed in the referenced commonly assigned application. Although it involves a metalworking operation, the improvement significantly enhances the durability of the interface between the sphere and the resilient spring disc, and the particular metalworking operation that is employed is a swaging operation which involves neither welding nor cutting. Briefly, the invention comprises the inclusion of a metal collar that is shaped to provide both an annular cradling surface for cradling the sphere and an annular bearing surface for bearing against the inner annular margin of the spring disc. The invention greatly reduces wear that might otherwise occur at the sphere/disc interface and disrupt the desired dynamic flow characteristics of the fuel injector.

In a first embodiment of the invention, the collar is swaged onto the sphere so that the two become a unit wherein the sphere is incapable of swiveling within the collar. In a second embodiment, the collar is sized for a slightly larger sphere than the one with which it will be used in the injector, and the sphere used in the injector is provided with a flat at the location where the sphere is contacted by the armature. In this second embodiment, the sphere can swivel within the collar and thereby assume an orientation wherein the flat in the sphere has maximum surface area contact with, and thus minimum pressure against, the armature. Thus the interface between the armature and the sphere is also improved in this second embodiment.

Further features, advantages, and benefits of the invention will be seen in the ensuing description and claims which are accompanied by drawings. The drawings disclose a presently preferred embodiment of the invention according to the best mode contemplated at the present time in carrying out the invention.

DESCRIPTION OF THE PREFERRED EMBODIMENT

Figure 1:
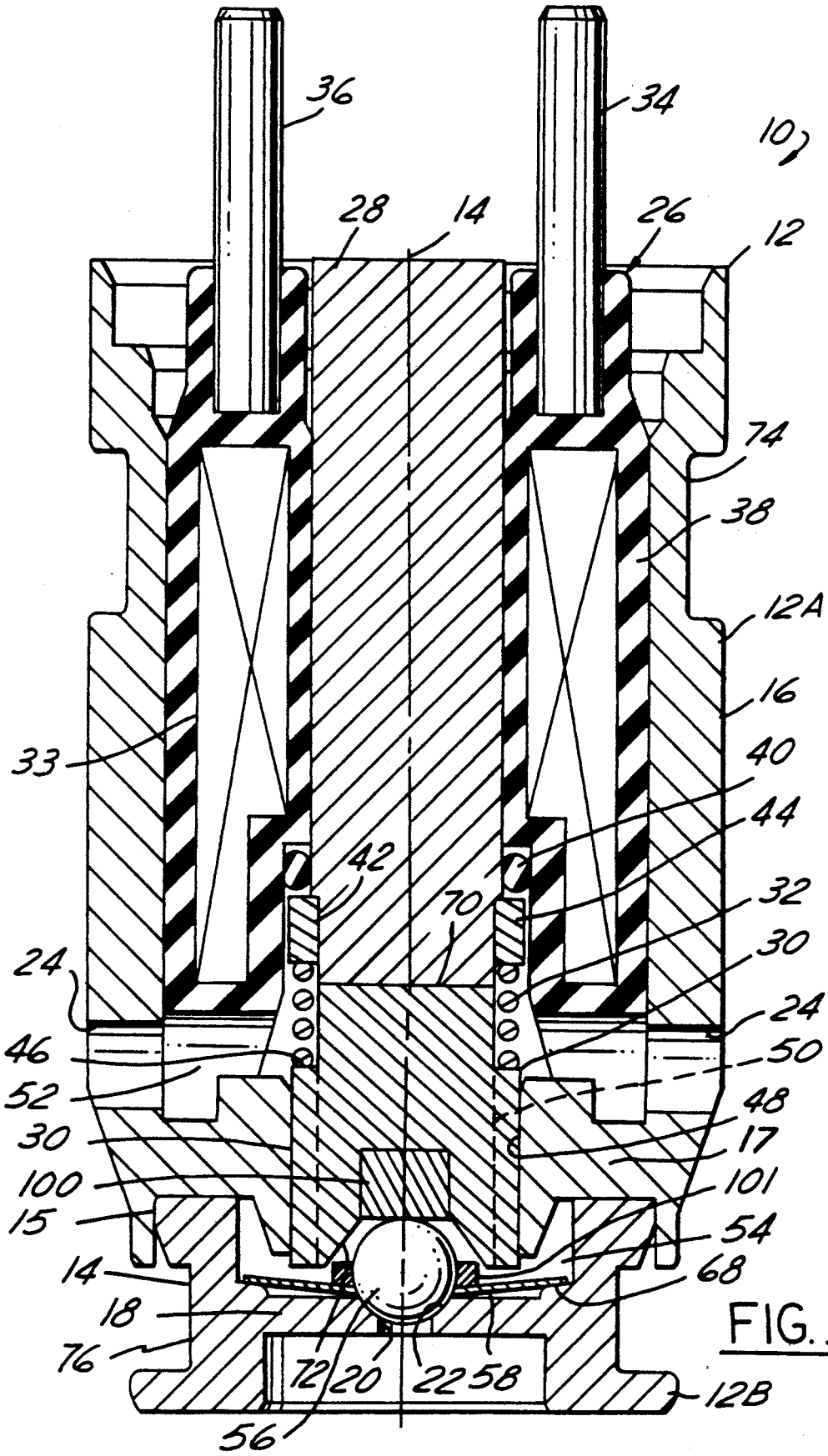
FIG. 1 is a longitudinal cross sectional view through a fuel injector valve embodying principles of the present invention.

The embodiment of electrically operated fuel injector valve 10 comprises a valve body 12 having a main longitudinal axis 14. Valve body 12 is composed of two separate parts 12A, 12B which are joined together at a joint 15. Valve body 12 comprises a cylindrical side wall 16 which is generally coaxial with axis 14 and an end wall 18 that is disposed at one longitudinal end of side Wall 16 generally transverse to axis 14. Part 12B contains end wall 18 and a portion of side wall 16. Part 12A contains the remainder of side wall 16, and it also comprises a transverse wall 19 which is spaced interiorly of end wall 18.

A circular through-hole 20 is provided in end wall 18 substantially coaxial with axis 14 to provide a fuel outlet from the interior of the valve body. Through-hole 20 has a frusto-conical valve seat 22 at the axial end thereof which is at the interior of the valve body. A thin disc orifice member (not shown) is typically disposed over the open exterior end of through-hole 20 so that the fuel that passes through through-hole 20 is emitted from the injector valve via one or more orifices in the thin disc orifice member.

The fuel injector valve has a fuel inlet in the form of plural radial holes 24 extending through side wall 16, and it also contains an internal fuel passage, to be hereinafter described in more detail, from the fuel inlet to the fuel outlet. Holes 24 are located immediately adjacent transverse interior wall 19, adjacent to the face thereof that is opposite the face against which part 12B is disposed. This configuration portrays what is commonly called a side- or bottom-feed type fuel injector.

Valve 10 further comprises an electrical actuator mechanism which includes a solenoid coil assembly 26, a stator 28, an armature 30, and a bias spring 32. Solenoid 26 comprises an electromagnetic coil 33 whose terminations are joined to respective electrical terminals 34, 36 which project longitudinally away from the valve at the end thereof which is opposite end wall 18. The terminals 34, 36 are configured for mating connection with respective terminals of an electrical connector plug (not shown) which is connected to the fuel injector valve when the valve is in use. The entirety of coil 33, including the attachment of its terminations to terminals 34, 36, is encapsulated in a suitable encapsulant 38 which gives the solenoid assembly a generally tubular shape.

Stator 28 has a general cylindrical shape which provides for it to be fitted within solenoid assembly 26 in the manner shown in FIG. 1 to concentrate the magnetic flux that is generated by coil 33 when the coil is electrically energized. The side wall of stator 28 is hydraulically sealed with respect to the inner side wall of solenoid assembly 26 by means of an elastomeric O-ring seal 40. Seal 40 prevents fuel that has been introduced into the interior of the valve via holes 24 from leaking out of the valve via any potential leak paths that may exist between the external cylindrical surface of the stator and the internal cylindrical surface of the solenoid assembly.

Stator 28 comprises a shoulder 42 on the fuel side of O-ring seal 40 and facing end wall 18. A bearing ring 44 having a rectangular cross-section as seen in FIG. 1 is disposed over the end of stator 28 that is toward end wall 18, and it bears against shoulder 42. Armature 30 has a shoulder 46 which faces ring 44. Spring 32 is disposed between ring 44 and shoulder 46 for the purpose of resiliently urging the armature longitudinally toward end wall 18.

Transverse interior wall 19 comprises a circular through-hole 48 that is coaxial with axis 14 and provides a guide for armature 30. That portion of the armature which is between shoulder 46 and the end of the armature that is toward end wall 18 has a circular cylindrical side wall surface dimensioned for a close sliding fit in through-hole 48. This cylindrical side wall surface of armature 30 is not circumferentially continuous, but rather is interrupted by axially extending slots 50 distributed circumferentially around the armature. These slots 50 form a portion of the internal fuel passage between the fuel inlet and the fuel outlet by establishing communication between a zone that lies at one longitudinal end of transverse wall 19 and a zone that lies at the opposite longitudinal end of wall 19. One of these two zones is an annular interior space 52 that lies interiorly of holes 24 and surrounds armature 30; the other is an interior space 54 that is circumferentially bounded by that portion of side wall 16 formed by part 12B and that is longitudinally bounded by wall 18 at one longitudinal end and by wall 19 and armature 30 at the opposite longitudinal end. It is within space 54 that the valve element of the fuel injector is disposed.

The valve element is a sphere 56 that in FIG. 1 is shown coaxial with axis 14 and seated on valve seat 22 to close through-hole 20. This represents the closed condition of fuel injector valve 10. In this condition the solenoid assembly is not electrically energized and so the resilient bias of spring 32 acting through armature 30 causes sphere 56 to be forcefully held on seat 22.

Sphere 56 is an entirely separate part that is not joined to any other part of the valve, except for the collar 101 to be hereinafter described in detail. Sphere 56 is constrained in a particular way so that it will follow the longitudinal motion of armature 30 when the latter is operated by the solenoid assembly, but in such a way that the sphere will always be self-centering on seat 22 when the valve is operated closed.

Figure 2:
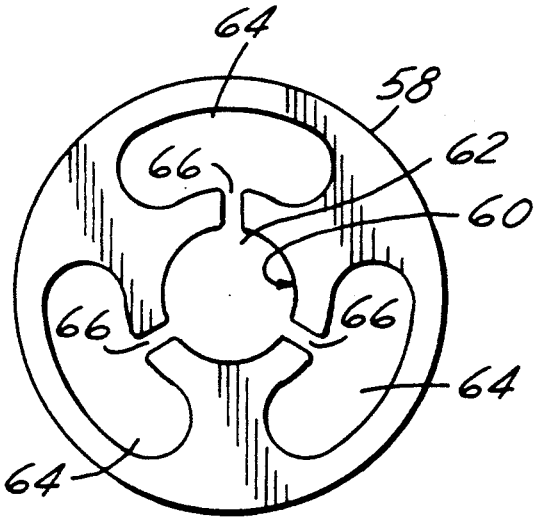
FIG. 2 is a slightly enlarged plan view of the resilient spring disc from the fuel injector valve of FIG. 1 shown by itself.

Additional mechanism which cooperates with armature 30 in controlling sphere 56 is a resilient spring disc 58 which is disposed in space 54 for coaction with sphere 56 via collar 101. The shape of disc 58, which is representative of one of a number of possible designs, can be best seen in FIG. 2. The disc contains a disc through-hole 60 which defines a central circular void 62 of a diameter less than the diameter of sphere 56. It also defines three kidney-shaped voids 64 which are arranged 120° apart and each of which is joined with void 62 by a corresponding radial slot 66. The radially outer circumferentially extending margin of the disc is circumferentially continuous.

Figure 3:
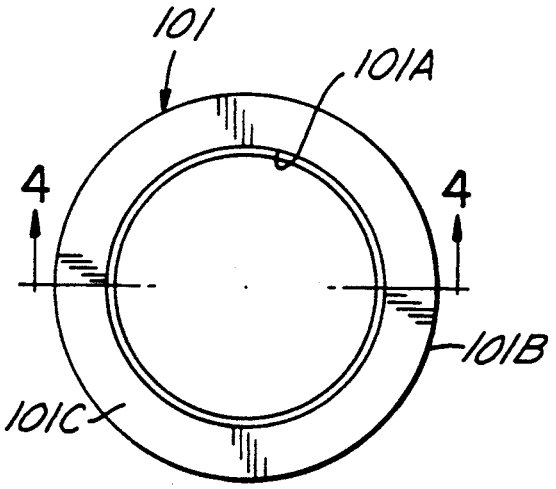
FIG. 3 is an enlarged plan view of the collar from the fuel injector valve of FIG. 1 shown by itself.
Figure 4:
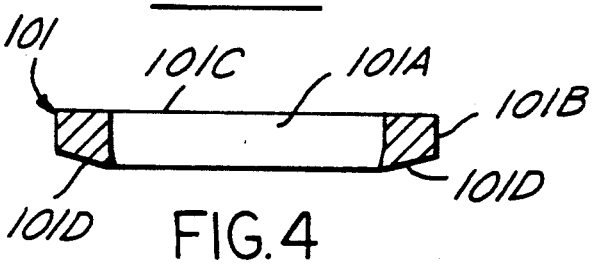
FIG. 4 is an enlarged cross sectional view in the direction of arrows 4—4 in FIG. 3.

Collar 101 provides the interface between sphere 56 and disc 58. Details of the shape of the collar can be perhaps best seen in FIGS. 3 and 4. Collar 101 is in the form of a circular ring which has an inside diameter surface 101A, an outside diameter surface 101B, and axial end surfaces 101C and 101D. FIG. 3 portrays an ideal shape which surface 101A would assume when united with sphere 56. This shape lies on the surface of an imaginary sphere that is concentric with sphere 56. Surface 101B lies on the surface of an imaginary right circular cylinder that is coaxial with axis 14. Surface 101C lies on an imaginary plane that is perpendicular to axis 14. Surface 101D lies on the surface of an imaginary right frustum that is coaxial with axis 14 and that has a cone angle substantially identical to the cone angle assumed by the underlying surface of spring disc 58 with which collar 101 abuts when the sphere is seated on seat 22 to close through-hole 20.

Sphere 56 and collar 101 are united in assembly to form a unitary component that is assembled into the fuel injector. Such assembly is accomplished by swaging the collar onto the sphere. The swaging operation is in the nature of cold-forming, and therefore, before the operation is conducted, collar 101 is provided with a shape and constitution that will allow it to deform onto the sphere and create the desired final shape that has been described. Since the sphere is typically stainless steel which has a relatively hard surface, the collar is made of a somewhat softer deformable material, preferably a softer stainless steel such as 300 grade stainless steel. The inside diameter surface 101A of the collar is dimensioned smaller than the diameter of the sphere. The difference is so chosen that at the conclusion of the swaging operation that unites the sphere and collar, the sphere will axially protrude a predetermined distance beyond the collar while the collar tightly girdles the sphere. The swaging operation is conducted by cradling the sphere in the collar and relatively pressing them together. The predetermined protrusion distance is chosen to assure that the portion of the sphere which is axially coextensive with circular void 62 (i.e. that portion which is circumferentially bounded by the void) is slightly smaller than void 62. With such assurance, it will be further assured that action between the sphere and the spring disc will be transmitted via the collar. Furthermore, the predetermined protrusion distance is selected to assure that the spring disc's force contribution to the force acting on the sphere, and hence on the armature too, is that which is intended for the particular design.

Disc 58 and sphere 56 are disposed in valve 10 such that sphere 56 fills just slightly less than the entirety of void 62. End wall 18 contains a raised annular ledge 68 surrounding seat 22 coaxial with axis 14. The circumferentially continuous outer peripheral margin of disc 58 rests on ledge 68. The diameter of the disc is less than the diameter of space 54 so that the disc is capable of a certain limited amount of radial displacement within space 54.

In the closed condition shown in FIG. 1, the resilient bias force exerted by spring 32 acting through armature 30 on sphere 56, in addition to forcing the sphere to close through-hole 20, has also flexed spring disc 58 so that the spring disc is exerting a certain force on the sphere via collar 101 in the opposite direction from the force exerted by spring 32. In this closed condition, there is a small gap 70 between confronting end faces of stator 28 and armature 30.

The energization of solenoid assembly 26 will exert an overpowering force on armature 30 to reduce gap 70 thereby further compressing spring 32 in the process. The resulting motion of the armature away from sphere 56 means that the dominant force applied to the sphere during this time is that which is exerted by disc 58 via collar 101 in the direction urging the sphere/collar unit toward the armature. Disc 58 is designed through use of conventional engineering design calculations to cause the sphere/collar unit to essentially follow the motion of the armature toward stator 28. The result is that the sphere unseats from seat 22 to allow the pressurized liquid fuel that is present within the interior of the fuel injector to pass through through-hole 20. So long as sphere 56 remains unseated from seat 22, fuel can flow from holes 24 through space 52, through slots 50, through space 54 predominantly via voids 64, to the fuel outlet at through-hole 20.

When solenoid assembly 26 is de-energized, the magnetic attraction force on armature 30 dissipates to allow spring 32, acting through the armature, to cause the sphere to re-seat on seat 22 and close through-hole 20. It is to be observed that the amount of longitudinal travel of the armature is quite small so that a portion of the sphere will always be disposed in seat 22 even though the sphere itself may not be closing through-hole 20 to fuel flow. If for any reason sphere 56 were to become eccentric with respect to seat 22, the reaction of the sphere with the valve seat in response to armature motion tending to close the valve will create a self-centering tendency toward correcting the eccentricity. This self-centering tendency is allowed to occur because disc 58 is unattached to the valve body, i.e. the disc is prevented from itself preventing the sphere from ultimately centering itself on the seat to close the through-hole. Stated another way, the sphere and disc can "float" radially as a unit so that any eccentricity which may exist between the sphere and the seat is eliminated as the armature operates to force the sphere against the seat toward the final objective of closing the fuel outlet.

While a valve embodying the inventive principles will exhibit the highly advantageous self-centering of the sphere upon closing, a further distinct advantage is that during the process of assembly of the valve, the disc and sphere/collar unit are merely two separate components that are assembled into the fuel injector. There is no joining or metalworking operation that is required to unite them as a sub-assembly. The sphere is, of course, fabricated by conventional ball fabrication technology, and the resilient spring disc is fabricated by conventional metalworking techniques. Therefore, even if there is some degree of misalignment (i.e. eccentricity) between the sphere and the seat after the valve has been assembled, commencement of operation will immediately cause the sphere to become centered on the seat so that proper closure of through-hole 20 will be attained when the valve is in the closed position.

While the sphere has thus been shown to be axially captured between armature 30 and disc 58, there is also a certain radial confinement that is provided by the particular shape of the armature tip end. The tip end of the armature is shaped to have a frusto-conical surface 72 that is essentially coaxial with axis 14. When sphere 56 is seated on seat 22, surface 72 is spaced from the sphere. There is thus a limited range of radial displacement (eccentricity relative to axis 14) for the sphere which will be tolerated before surface 72 will actively prevent any further radial displacement of the sphere, provided that the difference between the outside diameter of spring disc 58 and the inside diameter of the side wall surface that circumferentially bounds space 54 is large enough to permit the sphere to abut surface 72. In the illustrated embodiment this difference is not large enough. It is also to be observed that the armature is in fact a two part construction comprising a main armature body 30 and a hardened insert 100 which provides the contact surface with sphere 56 to axially capture the sphere. The radial confinement provided by surface 72 will keep the sphere at least proximately concentric within the axis within the radial confinement imposed on the sphere by the tip end of the armature, while still allowing the disc and sphere together to be radially displaced relative to the axis such that when the injector operates to closed position any eccentricity of the sphere relative to the valve seat will be removed by the camming effect of the seat on the sphere with the result that the sphere precisely centers itself on the seat to thereby fully close through-hole 20.

In use, the injector is typically operated in a pulse width modulated fashion. The pulse width modulation creates axial reciprocation of the sphere so that fuel is injected as separate discrete injections. The exterior of side wall 16 contains axially spaced apart circular grooves 74, 76 which are adapted to receive O-ring seals (not shown) for sealing of the injector body to an injector-receiving socket into which a side-feed type injector is typically disposed. The organization and arrangement of the illustrated injector provides for compactness and for assembly processing by automated assembly equipment. The overall fabrication process can be conducted in a more efficient manner in comparison to prior processes because the inherent self-centering characteristic does not require as highly precise finishing and alignment of parts as required in the prior processes described above. Moreover, the sphere/collar unit and the disc are separate components that are simply assembled into the fuel injector during the assembly process. The dimensional tolerances on certain parts can be greater (thereby making those parts less costly), plus the organization and arrangement is definitely conducive to fuel injector valve miniaturization.

The sphere-girdling collar 101 is effective in distributing the forces acting between the sphere and the spring disc over larger surface areas than in the case of a construction where the sphere has what amounts essentially to edge contact with the spring disc. The direct result is significantly improved durability while retaining the benefits of the "floating" sphere and disc. Without the collar, it may happen that the edge contact between the spring disc and the sphere wears away the inner edge of the spring disc with resultant significant relaxation of spring disc force acting on the sphere and an accompanying change in the dynamic characteristics of the injector. By maximizing the area of contact between the collar and the spring disc, as explained above by having the cone angle of surface 101D the same as that of the underlying surface of the spring disc, the applied pressure is minimized resulting in reduced stress in the parts.

Figure 5:
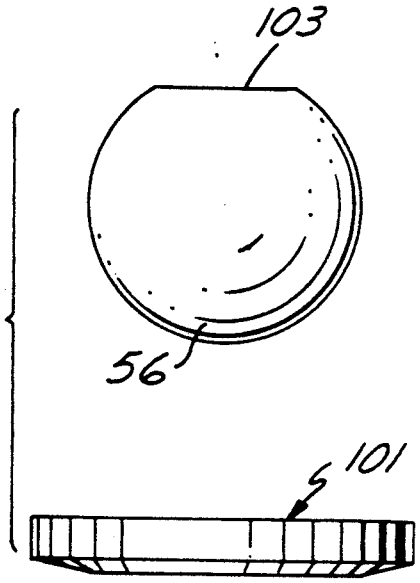
FIG. 5 is an exploded view of an alternate embodiment of collar and sphere.

FIG. 5 depicts a second embodiment of sphere and collar, which are identified by the same reference numerals as those used in the first embodiment. Although FIG. 5 shows the components in exploded relation, it is to be understood that when assembled into a fuel injector, the sphere protrudes through and beyond the collar in the same manner as in the first embodiment. In this second embodiment, a small flat 103 is created in sphere 56, and collar 101 is not swaged onto the sphere. Rather the inside diameter surface of the collar lies on the surface of an imaginary sphere that is slightly larger than the diameter of sphere 56, perhaps 0.002 inch larger for example. The protrusion of the sphere beyond the collar is selected according to the same criteria as for the first embodiment. Yet in the second embodiment, the sphere can swivel within the collar, and this allows flat 103 to align with the flat abutting end surface of insert 100 so that maximum surface area contact between the armature and the sphere is attained. Thus, this second embodiment has the added advantage of improved sphere-/armature interfacing. The collar can be properly sized by first swaging it a predetermined distance onto a slightly larger diameter sphere and then removing that sphere.

By way of illustration, and not limitation, a fuel injector that has a 0.140 inch diameter sphere may have a collar that has an inside diameter surface of about 0.130 inch, an outside diameter surface of about 0.187 inch, and a thickness of about 0.030 inch. Collars can be manufactured by machining from solid stock, or by severing from a suitably sized tube.

While a preferred embodiment of the invention has been illustrated and described, it is to be appreciated that principles are applicable to other embodiments.

What is claimed is:

1. An electrically operated valve comprising a valve body having a main longitudinal axis, said valve body comprising a cylindrical sidewall that is generally coaxial with said axis and laterally bounds the interior of said valve body and an end wall that is disposed at one longitudinal end of said sidewall generally transverse to said axis, a through-hole disposed in said end wall substantially coaxial with said axis and forming a portion of a fluid path through the valve, said through-hole having a frustoconical valve seat at the axial end thereof which is at the interior of said valve body, said valve body having an inlet and an outlet for said fluid path, said valve body further comprising means defining a raised ledge on the interior thereof which encircles said valve seat in radially outwardly spaced relation thereto, a resilient spring disc whose radially outer peripheral margin is supported on, but otherwise unattached to, said raised ledge and which comprises a disc through-hole comprising a central circular void of given diameter, a sphere whose diameter exceeds said given diameter and which is disposed in said disc through-hole to fill slightly less than said circular void, an electrically operated mechanism disposed on said valve body and comprising a longitudinally reciprocal armature means and a bias means that are effective in cooperation with said spring disc to selectively seat and unseat sphere on and from said seat in accordance with the manner in which said mechanism is electrically operated, said armature means comprising a tip end that in cooperation with said spring disc axially captures said sphere, such capture being effective to cause said sphere to axially reciprocate with the reciprocal motion of said armature means and thereby selectively seat on and unseat from said seat, and said disc having a size in relation to said valve body that keeps said sphere at least approximately concentric with said axis by allowing the disc and sphere together to be radially displaced relative to said axis such that when said mechanism operates to close the fuel injector by displacing said sphere toward said seat, any eccentricity of the sphere relative to said seat is removed by the camming effect of said seat on said sphere with the result that said sphere precisely centers itself on said seat to thereby fully close said first-mentioned through-hole while continuing to fill just slightly less than said void, and a collar that girdles said sphere and provides the interface between the sphere and the disc, said collar comprising an inside diameter surface that circumferentially engages said sphere and a further surface that abuts said disc in circumferentially bounding relation to said void.

2. A valve as set forth in claim 1 in which the outer margin of said spring disc is circumferentially continuous.

3. A valve as set forth in claim 2 in which a portion of said fluid path comprises a portion of said disc through-hole that is disposed radially outwardly of said void.

4. A valve as set forth in claim 1 in which said further surface of said collar is circumferentially continuous.

5. A valve as set forth in claim 4 in which said further surface of said collar lies on an imaginary frustum whose cone angle is substantially the same as that of a portion of said disc circumferentially bounding said void.

6. A valve as set forth in claim 1 in which said further surface of said collar lies on an imaginary frustum whose cone angle is substantially the same as that of a portion of said disc circumferentially bounding said void.

7. A valve as set forth in claim 1 in which said collar is united with said sphere so that said sphere is incapable of swivelling within the collar.

8. A valve as set forth in claim 1 in which said collar is related to said sphere so that said sphere is capable of swivelling within the collar.

9. A valve as set forth in claim 8 in which said sphere includes a flat that is in abutment with said armature such that the action of said armature with said flat forces said flat to have maximum surface area contact with said armature.

10. A tip end for an electrically-operated fluid valve comprising an end wall containing a central through-hole through which fluid passes and which has a frusto-conical valve seat on the interior, a sphere that is disposed substantially concentric with said valve seat and reciprocates in response to an electric signal delivered to the valve to seat on and unseat from said valve seat, and means to maintain said sphere substantially concentric with said valve seat while allowing the sphere to center itself on the valve seat when the sphere is operated to close said through-hole, said means comprising a resilient spring disc containing a disc through-hole comprising a central circular void of diameter less than the diameter of said sphere, said sphere filling slightly less than said void, and a raised ledge concentrically surrounding said valve seat in outwardly spaced relation thereto, said disc having an outer circumferential margin that is supported on, but otherwise unattached to, said ledge in such a manner as to provide for limited radial displacement of said disc preventing said disc from preventing said sphere from ultimately precisely centering itself on said valve seat whenever said sphere is eccentric to said valve seat during the process of seating on said valve seat, and a collar that girdles said sphere and provides the interface between the sphere and the disc, said collar comprising an inside diameter surface that circumferentially engages said sphere and a further surface that abuts said disc in circumferentially bounding relation to said void.

11. A tip end as set forth in claim 10 in which the outer margin of said spring disc is circumferentially continuous.

12. A tip end as set forth in claim 11 in which said further surface of said collar is circumferentially continuous.

13. A tip end as set forth in claim 12 in which said further surface of said collar lies on an imaginary frustum whose cone angle is substantially the same as that of a portion of said disc circumferentially bounding said void.

14. A tip end as set forth in claim 10 in which said further surface of said collar lies on an imaginary frustum whose cone angle is substantially the same as that of a portion of said disc circumferentially bounding said void.

15. A tip end as set forth in claim 10 in which said collar is united with said sphere so that said sphere is incapable of swivelling within the collar.

16. A tip end as set forth in claim 10 in which said collar is related to said sphere so that said sphere is capable of swivelling within the collar.

17. A tip end as set forth in claim 16 in which said sphere includes a flat that is adapted for abutment with an armature of the valve such that the action of the armature with said flat will force said flat to have maximum surface area contact with the armature.

* * * * *